US011134735B2

(12) United States Patent
Lee et al.

(10) Patent No.: US 11,134,735 B2
(45) Date of Patent: Oct. 5, 2021

(54) ADHESIVE AGENT APPLICATION DEVICE, METHODS FOR APPLYING ADHESIVE AGENT AND METHODS FOR PRODUCING EYELASH RECEPTOR USING THE SAME

(71) Applicants: Hwa Seok Lee, Seoul (KR); Nam Gyu Chung, Gyeonggi-do (KR)

(72) Inventors: Hwa Seok Lee, Seoul (KR); Nam Gyu Chung, Gyeonggi-do (KR); Youn Jin Seouk, Seoul (KR)

(73) Assignees: Hwa Seok Lee, Seoul (KR); Nam Gyu Chung, Gyeonggi-Do (KR)

( * ) Notice: Subject to any disclaimer, the term of this patent is extended or adjusted under 35 U.S.C. 154(b) by 160 days.

(21) Appl. No.: 16/376,931

(22) Filed: Apr. 5, 2019

(65) Prior Publication Data

US 2019/0307193 A1 Oct. 10, 2019

(30) Foreign Application Priority Data

Apr. 9, 2018 (KR) ..... 10-2018-0041157

(51) Int. Cl.

| | |
|---|---|
| ***A41G 5/02*** | (2006.01) |
| ***B05B 13/02*** | (2006.01) |
| ***B05D 5/10*** | (2006.01) |

(52) U.S. Cl.

CPC ..... *A41G 5/02* (2013.01); *B05B 13/0228* (2013.01); *B05B 13/0285* (2013.01); *B05B 13/0292* (2013.01); *B05D 5/10* (2013.01)

(58) Field of Classification Search

CPC ... A41G 5/02; B05D 5/10; B05D 1/02; B05B 13/0292; B05B 13/0421; B05B 13/0228

See application file for complete search history.

(56) References Cited

U.S. PATENT DOCUMENTS

2016/0286881 A1* 10/2016 Ko ..... A41G 5/02
2018/0029061 A1* 2/2018 Hayama ..... B25J 15/0019

FOREIGN PATENT DOCUMENTS

| | | | |
|---|---|---|---|
| CN | 107206413 | A | 9/2017 |
| JP | H08-108123 | A | 4/1996 |
| JP | 2607821 | B2 | 5/1997 |
| KR | 10-1110563 | B1 | 2/2012 |
| KR | 10-1520082 | B1 | 5/2015 |
| WO | 2015/087038 | A2 | 6/2015 |

* cited by examiner

*Primary Examiner* — Vishal I Patel
(74) *Attorney, Agent, or Firm* — Bishop, Diehl & Lee, Ltd.

(57) ABSTRACT

An adhesive agent application device comprises a support member holder fixedly holding an eyelash support member and an adhesive agent applicator configured to apply an adhesive agent to an adhesive portion of the eyelash support member held on the support member holder. The adhesive agent applicator comprises a nozzle configured to apply the adhesive agent, and a rotation arm connected to the nozzle, the rotation arm being rotatable with respect to the support member holder.

10 Claims, 9 Drawing Sheets

ADHESIVE AGENT APPLICATION DEVICE, METHODS FOR APPLYING ADHESIVE AGENT AND METHODS FOR PRODUCING EYELASH RECEPTOR USING THE SAME

CROSS-REFERENCE TO RELATED APPLICATIONS

This application is based on and claims priority from Korean Patent Application No. 10-2018-0041157, filed on Apr. 9, 2018, the disclosure of which is incorporated herein in its entirety by reference for all purposes.

TECHNICAL FIELD OF INVENTION

Embodiments of the present invention relates to an adhesive agent application device, a method for applying an adhesive agent and a method for producing an eyelash supporter using the same.

BACKGROUND OF THE INVENTION

In general, false eyelashes are used for eye decoration of people with short eyelashes, and to this end, false eyelashes are used being fixed to the eyelids of the user.

Such eyelashes may be adhered to the eyelid by an adhesive member. Also, such false eyelashes may be formed to have a certain arc shape.

Also, false eyelashes may comprise a strand which becomes the base in order to retain a predetermined shape. Recently, false eyelashes which have an adhesive agent attached to the strand are in the market.

SUMMARY OF THE INVENTION

The embodiments of the present invention were invented with the above background, and aim at providing an adhesive agent application device, a method for applying an adhesive agent and a method for producing an eyelash supporter using the same, which can remarkably save manufacturing cost and time.

According to an embodiment of the present invention, an adhesive agent application device comprises a support member holder fixedly holding an eyelash support member and an adhesive agent applicator applying an adhesive agent to an adhesive portion of the eyelash support member held on the support member holder, wherein the support member holder fixedly holds the eyelash support member so as to retain the position and the posture of the eyelash support member while the adhesive agent is applied to the adhesive portion of the eyelash support member. The adhesive agent applicator comprises a nozzle spraying the adhesive agent and a rotation arm configured to be connected to the nozzle and rotatable with respect to the support member holder, so as to rotate the nozzle so that the nozzle moves along a moving path of an upwardly convex circular arc shape, wherein the nozzle is configured to spray, by the rotation arm, the adhesive agent in a circular arc shape at a position between the moving path of an upwardly convex circular arc shape of the nozzle and the rotation center of the nozzle.

The adhesive agent applicator further comprises a nozzle supporter movably connected with respect to the rotation arm to support the nozzle and a supporter transporter for moving the nozzle supporter with respect to the rotation arm.

Further, the nozzle supporter is configured to perform a linear movement in a direction advancing to and retreating from the eyelash support member held on the support member holder.

The adhesive agent applicator further comprises a rotation arm driver for rotating the rotation arm. The adhesive agent applicator is configured such that the nozzle rotates with respect to the eyelash support member held on the support member holder by rotating the rotation arm by the rotation arm driver.

Further, the rotation arm driver is driven to position the nozzle at an end part at one side of the adhesive portion of the eyelash support member before the adhesive agent is sprayed from the nozzle, and the supporter transporter is driven to perform the linear movement in a direction getting closer to the eyelash support member when the nozzle is positioned at an end part at one side of the adhesive portion of the eyelash support member.

The adhesive agent application device comprises a support member storing unit vertically extended for storing the eyelash support member before the adhesive agent is attached, a support member dispenser for taking out the eyelash support member stored in the support member storing unit from a lower side of the support member storing unit, and a support member holder for receiving the eyelash support member from the support member dispenser and moving the eyelash support member received to the nozzle side.

Further, the support member storing unit is configured such that a plurality of eyelash support members are vertically stacked to be stored, and the adhesive portion of the plurality of eyelash support members stored in the support member storing unit is arranged to face the horizontal direction.

Further, the adhesive agent application device comprises a main frame. The support member holder comprises a fixed arm fixed to the main frame to support a part of the eyelash support member; and an operation arm movably configured in a direction getting closer to the fixed arm so as to support the other part of the eyelash support member.

Further, a mounting groove having the other surface of the eyelash support member mounted thereon is formed on the operation arm, and the support member dispenser is configured to allow the eyelash support member arranged at the lowest end of the support member storing unit to be mounted on the mounting groove of the operation arm through linear movement.

Furthermore, according to another embodiment of the present invention, a method for applying an adhesive agent comprises a holding step of holding an eyelash support member on a support member holder; and an adhesive agent applying step of applying an adhesive agent to an adhesive portion of the eyelash support member held on the support member holder. The adhesive agent applying step comprises a nozzle rotating step of rotating a nozzle spraying the adhesive agent with respect to the eyelash support member held on the support member holder. While the adhesive agent is applied to the adhesive portion of the eyelash support member in the adhesive agent applying step, the support member holder fixedly holds the eyelash support member to retain the position and the posture of the eyelash support member. In the nozzle rotating step, the nozzle rotates to move along the moving path of an upwardly convex circular arc shape, and the nozzle applies the adhesive agent in a circular arc shape at a position between the moving path of an upwardly convex circular arc shape of the nozzle and the rotation center of the nozzle.

Furthermore, according to another embodiment of the present invention, a method for producing an eyelash supporter comprises a holding step of holding an eyelash support member on a support member holder; and an adhesive agent applying step of applying an adhesive agent to an adhesive portion of the eyelash support member held on the support member holder. The adhesive agent applying step comprises a nozzle rotating step of rotating a nozzle spraying the adhesive agent with respect to the eyelash support member held on the support member holder. While the adhesive agent is applied to the adhesive portion of the eyelash support member in the adhesive agent applying step, the support member holder fixedly holds the eyelash support member to retain the position and the posture of the eyelash support member. In the nozzle rotating step, the nozzle rotates to move along the moving path of an upwardly convex circular arc shape, and the nozzle applies the adhesive agent in a circular arc shape at a position between the moving path of an upwardly convex circular arc shape of the nozzle and the rotation center of the nozzle.

According to the embodiments of the present invention, the present invention has an effect of remarkably reducing manufacturing cost and time for producing an eyelash supporter to which an adhesive agent is pre-applied, and attaching false eyelashes to said eyelash supporter by applying an adhesive agent to the eyelash support member.

DETAILED DESCRIPTION OF A PREFERRED EMBODIMENT

Figure 1:
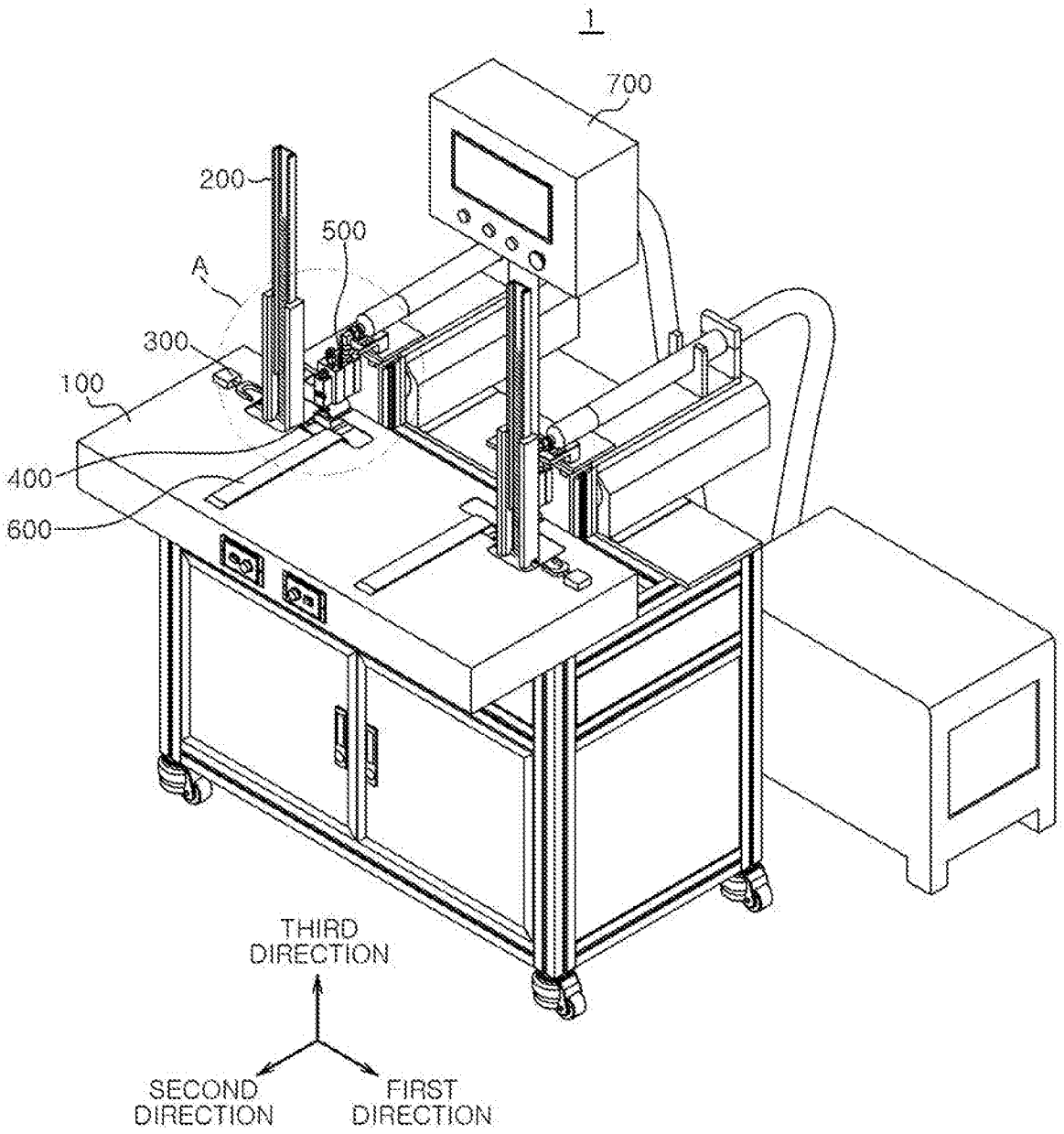
FIG. 1 is a perspective view of an adhesive agent application device according to an embodiment of the present invention.
Figure 2:
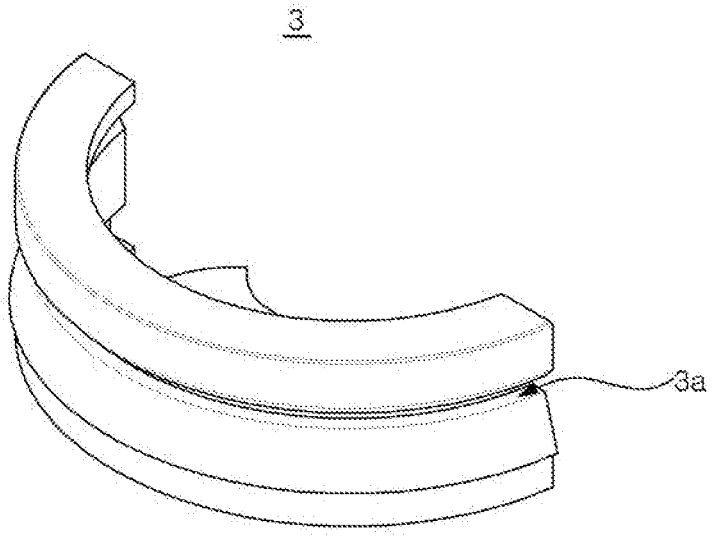
FIG. 2 is a perspective view of an eyelash support member to which an adhesive agent is to be applied by the adhesive agent application device of FIG. 1.
Figure 3:
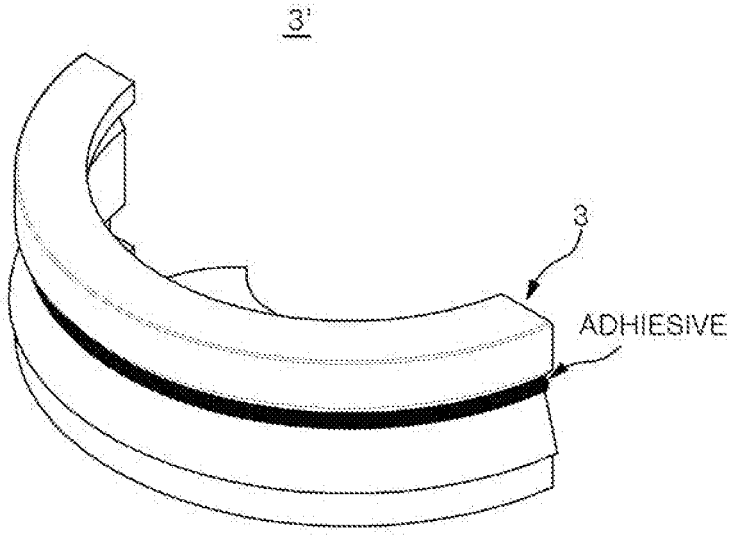
FIG. 3 is a perspective view of an eyelash supporter produced by the adhesive agent application device of FIG. 1.

Hereinafter, configurations and operations of embodiments will be described in detail with reference to the accompanying drawings. The following description is one of various patentable aspects of the present disclosure and may form a part of the detailed description of the present disclosure.

However, in describing the present disclosure, detailed descriptions of known configurations or functions that make the present disclosure obscure may be omitted.

The present disclosure may be modified and include various embodiments. Specific embodiments will be exemplarily illustrated in the drawings and described in the detailed description of the embodiments. However, it should be understood that they are not intended to limit the present disclosure to specific embodiments but rather to cover all modifications, similarities, and alternatives that are included in the spirit and scope of the present disclosure.

When it is said that a component is "connected", "transport" or "linked" to another component, it should be understood that the former component may be directly connected, transport or linked to the latter component or a third component may be interposed between the two components.

Specific terms in the present disclosure are used simply to describe specific embodiments without limiting the present disclosure. An expression used in the singular encompasses the expression of the plural, unless it has a clearly different meaning in the context.

Hereinafter, an adhesive agent application device 1 according to an embodiment of the present invention will be explained in detail with reference to the drawings.

The adhesive agent application device 1 may apply an adhesive agent to an adhesive portion 3*a* of an eyelash support member 3. The adhesive agent applied to the adhesive portion 3*a* and the eyelash support member 3 may be defined as an eyelash supporter 3'. The adhesive agent of the eyelash supporter 3' is attached to false eyelashes, so that the false eyelashes are accommodated in the eyelash supporter 3'. The false eyelashes may comprise a strand which is bent in a circular arc shape similar to the shape of the eyes and acts as a core, and a plurality of eyelash units which have an end attached to the strand and have the shape of eyelash hairs.

The eyelash support member 3 may be a member formed in a circular arc shape, and may be formed with the adhesive portion 3*a* extending along the circular arc. The adhesive portion 3*a* may have the shape of a groove, and at least one adhesive portion 3*a* may be provided. The adhesive agent application device 1 may apply an adhesive agent along the adhesive portion 3*a* extending in a circular arc shape, and the strand of the false eyelashes may be attached to the adhesive portion 3*a* to which the adhesive agent is applied. Such adhesive agent may be a semisolid type adhesive agent, for example, an adhesive agent of a hot melt type. The eyelash support member 3 may hold and/or support the false eyelashes through an adhesive agent. The false eyelashes may be supported at the adhesive portion 3*a* of the eyelash support member 3 by the adhesive agent.

The adhesive agent application device 1 may comprise a main frame 100, a support member storing unit 200, a support member dispenser 300, a support member holder 400, an adhesive agent applicator 500, a transport device 600, and a control unit 700. Also, the adhesive agent application device 1 may further comprise a false eyelash attaching device (not shown).

The main frame 100 may support the support member storing unit 200, the support member dispenser 300, the support member holder 400, and the adhesive agent applicator 500. Such main frame 100 may have the shape of a table.

The support member storing unit 200 may accommodate the eyelash support member 3 before attaching an adhesive agent thereto. The support member storing unit 200 may be configured to be separable from the main frame 100. The support member storing unit 200 may be extended in a third direction, and may comprise a storage space 210 for storing the eyelash support member 3 therein, and an outlet 220 connected to the storage space 210 so that the eyelash support member 3 inside the storage space 210 is discharged. The outlet 220 may be provided at a lower side of the storage space 210. The support member storing unit 200 may accommodate a plurality of eyelash support members 3 therein, and the eyelash support member 3 may be vertically stacked in the support member storing unit 200 [FIG. 4]. The adhesive portion 3*a* of the plurality of eyelash support members 3 stacked in the support member storing unit 200 may be arranged to face the horizontal direction. For example, the adhesive portion 3*a* of the eyelash support member 3 may be arranged to face the front.

The support member dispenser 300 may take out the eyelash support member 3 stored in the support member storing unit 200 and move the same to the support member holder 400. The support member dispenser 300 may comprise a dispenser body 310 and a dispenser operating unit 320. The dispenser body 310 may comprise a pneumatic piston configured so that the dispenser operating unit 320 performs a linear reciprocating movement. The dispenser operating unit 320 may be configured to perform a linear movement, and through the linear movement, the support member storing unit 200 may allow the eyelash support member 3 at the lowest end to be mounted on a mounting groove 431 of an operation arm 430 which will be explained in the following. The dispenser operating unit 320 may be configured to extend smoothly and continuously in a first direction without any raised spots, grooves, protrusions, etc. so that the eyelash support member 3 does not get caught in other eyelash support members 3 stacked at an upper side of the eyelash support member 3 to be taken out, when taking out the eyelash support member 3. The terms "a first direction," "a second direction" and "a third direction" used in the present specification and drawings are used to express directions different from one another. For example, a first direction may be one direction on a horizontal surface, a second direction may be a direction orthogonal to the first direction on the horizontal surface, and a third direction may be a direction vertical to the horizontal surface, and each direction may be orthogonal to one another.

The support member holder 400 may fixedly hold the eyelash support member 3 to apply an adhesive agent to the eyelash support member 3. The support member holder 400 may fix the eyelash support member 3 so that the adhesive portion 3*a* of the eyelash support member 3 faces a nozzle 560 which will be explained in the following of the adhesive agent applicator 500 while an adhesive agent is applied to the eyelash support member 3 by the adhesive agent applicator 500. In other words, the support member holder 400 retains the posture of the eyelash support member 3 so that the eyelash support member 3 does not rotate while an adhesive agent is applied to the eyelash support member 3 by the adhesive agent applicator 500. Also, the support member holder 400 may fixedly hold the eyelash support member 3 so that the starting point of the circular arc shape of the adhesive portion 3*a* of the eyelash support member 3 is placed in the rotation center of a rotation arm 520 when seen from the first direction.

The support member holder 400 may comprise a fixed arm 420, an operation arm 430, and an arm operating unit 440. In the present specification, the arm is a term covering all features that have the function of holding, accommodating or supporting a member, and there is no limitation in the shape thereof.

The fixed arm 420 is supported by the main frame 100 so as not to move. A holding groove 421 concaved so as to accommodate any part of the eyelash support member 3 may be formed on the fixed arm 420. The holding groove 420 may have a shape corresponding to the shape of at least any part of the eyelash support member 3.

The operation arm 430 is supported by the main frame 100 to be rotatable. The mounting groove 431 concaved so as to accommodate the other part of the eyelash support member 3 may be formed on the operation arm 430. The mounting groove 431 may have a shape corresponding to the shape of at least the other part of the eyelash support member 3. The mounting groove 431 may be positioned lower than the holding groove 421.

Figure 4:
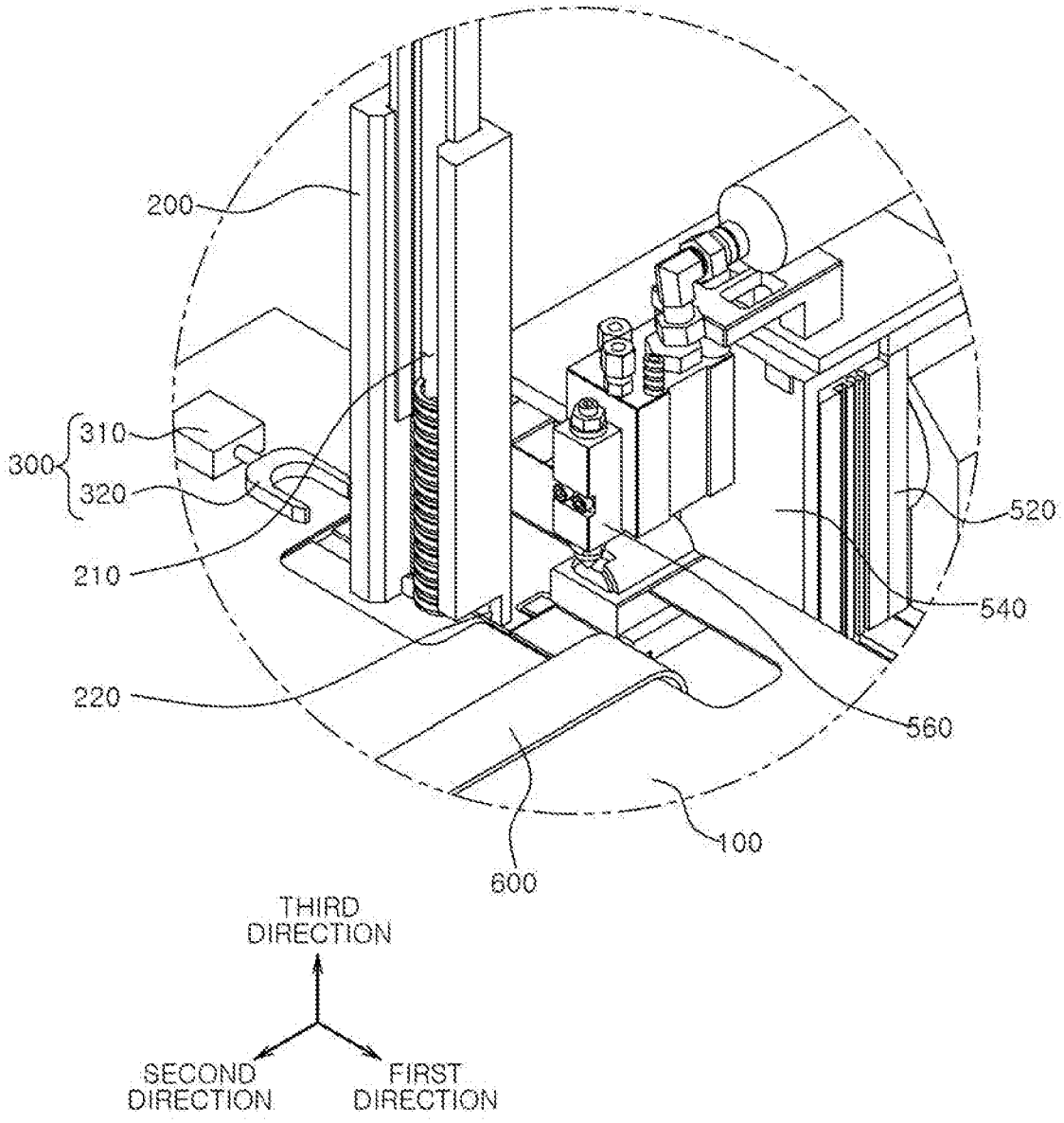
FIG. 4 is an enlarged view of part A in FIG. 1.
Figure 5:
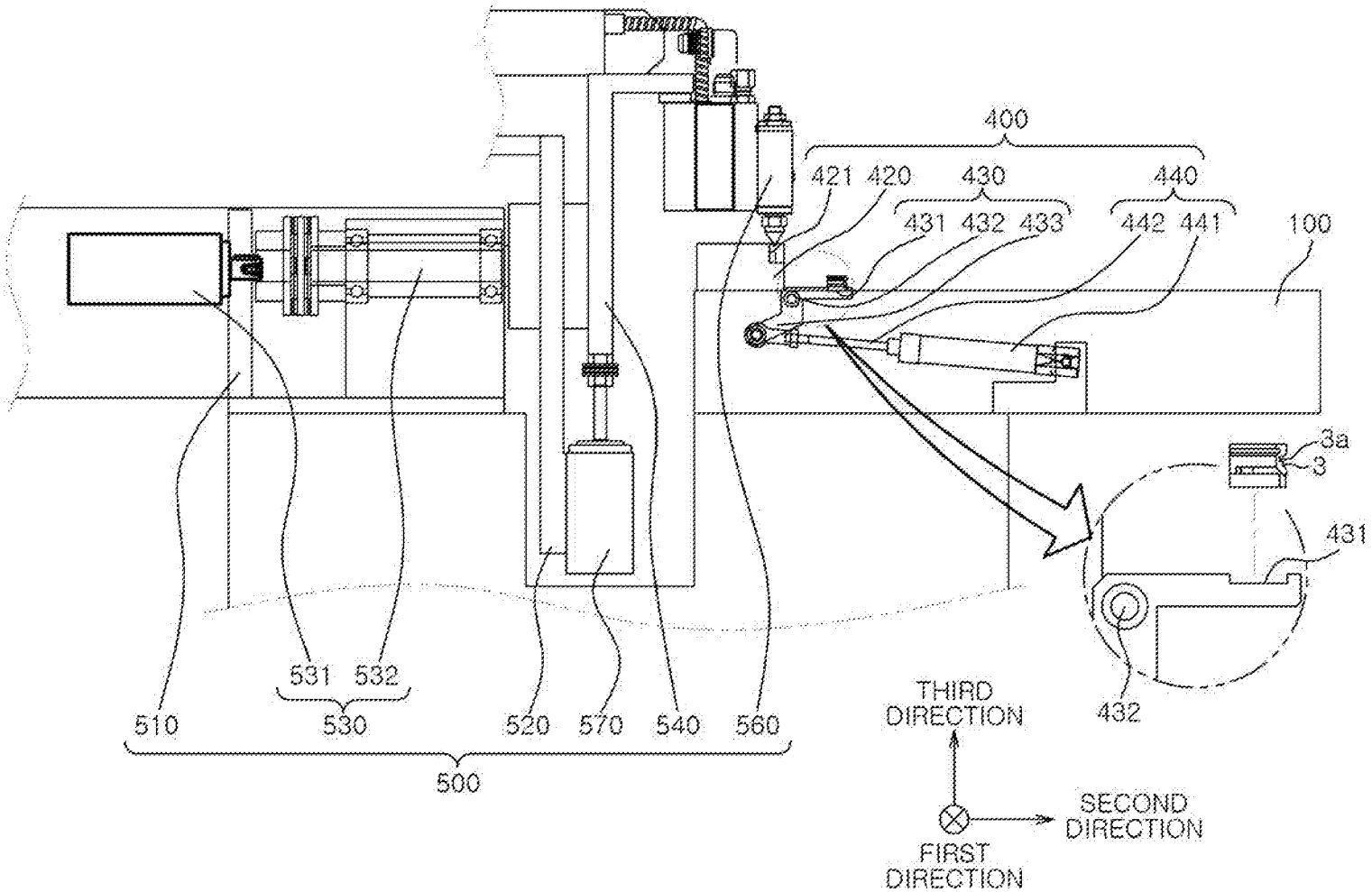
FIG. 5 is a side view of the adhesive agent application device of FIG. 1 seen from a first direction.
Figure 6:
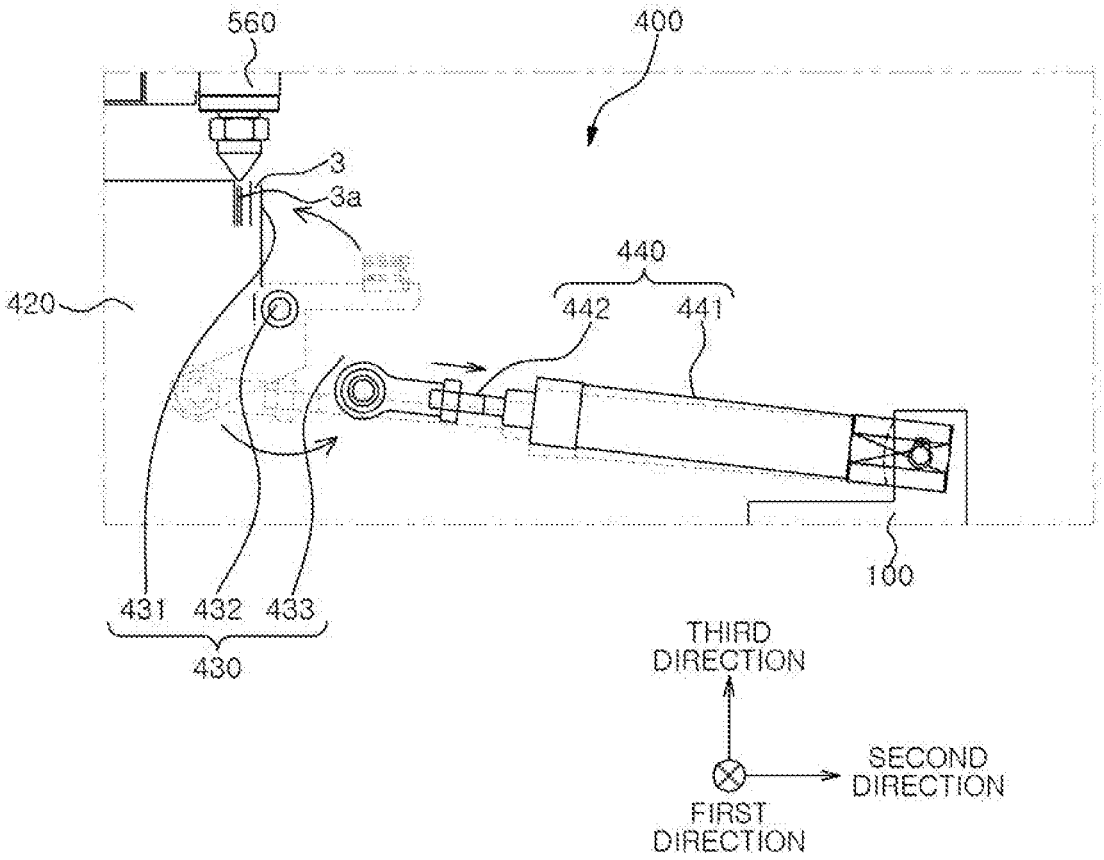
FIG. 6 is a side view of the operation of a support member holder of FIG. 5.
Figure 7:
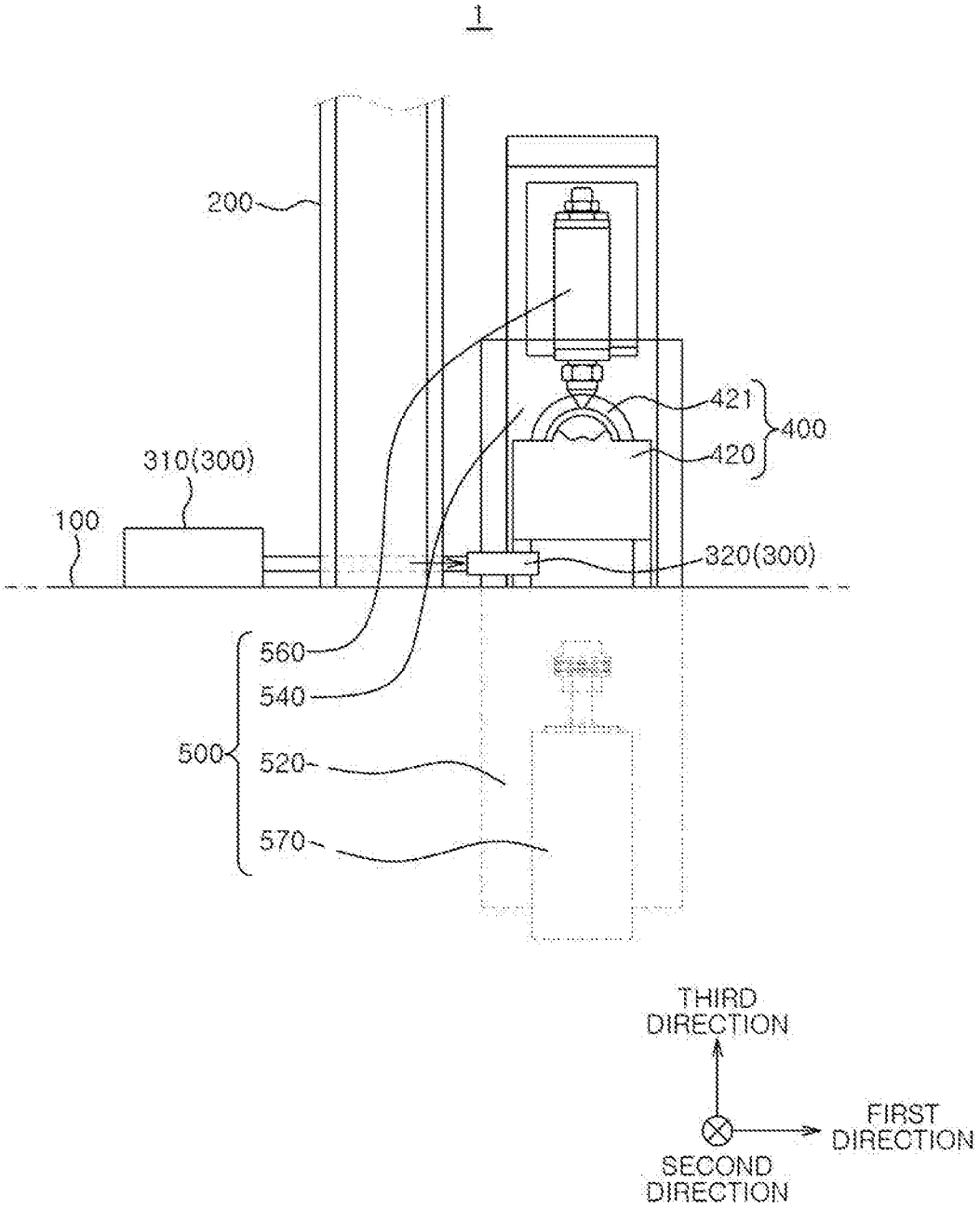
FIG. 7 is a front view of the adhesive agent application device of FIG. 1 seen from a second direction.

The operation arm 430 may be moved by the arm operating unit 440 to get closer to the fixing arm 420 in a state accommodating the eyelash support member 3. As illustrated in FIGS. 4 and 5, the operation arm 430 may further comprise an axis unit 432 connected to be rotatable with respect to the main frame 100, and a link unit 433 rotatably connected to a rotation link 442 which will be explained in the following of the arm operating unit 440. The axis unit 432 may be arranged between the center of the mounting groove 431 and the link unit 433. The axis unit 432 may be connected to the main frame 100 to enable a rotation movement where the operation arm 430 has a rotation axis extending in the first direction.

The operation arm 430 may receive the eyelash support member 3 at a first position, and then rotate to a second direction and move to the fixed arm 420 side. When the operation arm 430 rotates to the second direction, the eyelash support member 3 is accommodated in the holding groove 421 of the fixed arm 420 and the mounting groove 431 of the operation arm 430. The eyelash support member 3 is interposed between the fixed arm 420 and the operation arm 430, so as to stably retain the position and the posture thereof while the adhesive agent is applied.

The arm operating unit 440 may rotate the operation arm 430. The arm operating unit 440 may comprise an actuator 441 and the rotation link 442. The actuator 441 may generate a driving force for rotating the arm operating unit 440, and may be configured as a linear piston. The actuator 441 may be rotatably supported with respect to the main frame 100 at the other side of the rotation link 442. The rotation movement of the actuator 441 with respect to the main frame 100 may have a rotation axis extending in the first direction. An end part of the rotation link 442 is connected to the actuator 441 to perform a linear reciprocating movement with respect to the actuator 441. Also, the other end of the rotation link 442 may be rotatably connected to the link unit 433 of the operation arm 430. Therefore, the rotation link 442 and the operation arm 430 may operate to perform a relative rotation movement with respect to each other. The rotation movement between the rotation link 442 and the operation arm 430 may have a rotation axis extending in the first direction.

The adhesive agent applicator 500 may apply an adhesive agent to the eyelash support member 3 fixed to the eyelash supporter holder 400. The adhesive agent is applied along the adhesive portion 3*a* of the eyelash support member 3.

The adhesive agent applicator 500 may comprise an applicator frame 510, a rotation arm 520, a rotation arm driver 530, a nozzle supporter 540, a nozzle 560, and a supporter transporter 570.

The applicator frame 510 may support the rotation arm 520, the rotation arm driver 530 and an adhesive agent storage container (not illustrated). Also, the applicator frame 510 may rotatably support the rotation arm 520. The applicator frame 510 may be fixedly supported to the main frame 100. At least a part of the applicator frame 510 may be formed to upwardly extend along a third direction with respect to the main frame 100, and may support the rotation arm 520 to be spaced from the main frame 100 in the third direction.

The rotation arm 520 may be rotatably configured with respect to the applicator frame 510, and the rotation arm 520 may be rotated by the rotation atm driver 530. The rotation arm 520 may be formed to extend to both sides, the one side and the other side, with respect to the rotation axis. The rotation arm 520 may be connected to the nozzle 560 to support the nozzle 560. The rotation arm 520 may rotate so that an end part of the nozzle 560 moves along a moving path of an upwardly convex circular arc shape.

The rotation arm driver 530 may provide power for rotating the rotation arm 520. The rotation arm driver 530 may comprise a power providing unit 531, and a rotation axis 532 connected thereto. The power providing unit 531 may rotate the rotation axis 532, and be fixedly installed on the applicator frame 510 or the main frame 100. The rotation axis 532 may be extended along the second direction, and an end part is rotatably supported to the power providing unit 531, and the other end is fixedly supported to the rotation arm 520. The rotation arm 520 may be driven to rotate with respect to the rotation axis 532 extending in the second direction. Meanwhile, the rotation arm driver 530 may be, for example, a submotor, but the idea of the present invention is not necessarily limited thereto.

The nozzle supporter 540 may support the nozzle 560. The nozzle supporter 540 may be connected to the rotation arm 520 to perform the reciprocating movement. The nozzle supporter 540 may move the nozzle 560 in a direction getting closer to or away from the eyelash support member 3 held on the support member holder 400 by the reciprocating movement. For example, the nozzle supporter 540 may be configured to slide on the rotation arm 520. Meanwhile, the rotation arm 520 supporting the nozzle supporter 540 is rotatably configured with respect to the rotation axis 532, and thus the nozzle 560 may be configured to perform the reciprocating movement in a direction facing the rotation center of the rotation axis 532 wherever the rotation arm 520 is positioned.

The nozzle 560 may be supported to the nozzle supporter 540, and may spray an adhesive agent through a spraying hole. The nozzle 560 may apply an adhesive agent downward. The adhesive agent sprayed from the nozzle 560 may be applied along the adhesive portion 3*a* of the eyelash support member 3. The nozzle supporter 540 supporting the nozzle 560 and the rotation arm 520 are rotatably configured with respect to the rotation axis 532, and thus the nozzle 560 may be rotatable with respect to the rotation center of the rotation axis 532, and by such rotation, may move to a path having a circular arc shape along the adhesive portion 3*a* extending in a circular arc shape. The nozzle 560 applies the adhesive agent while rotating. The path of a circular arc shape along which the nozzle 560 moves may be formed to be convex. Therefore, the nozzle 560 may apply the adhesive agent along a path of an upwardly convex circular arc shape. When applying the adhesive agent, the nozzle 560 may have the end part thereof closely adhered to the adhesive portion 3*a* as much as possible.

The supporter transporter 570 may provide a driving force for moving the nozzle support 540 on the rotation arm 520. The supporter transporter 570 may comprise a body fixedly installed on the rotation arm 520, and an operating unit having an end part connected to the body and the other end connected to the nozzle supporter 540. The operating unit may be configured to perform the reciprocating movement with respect to the body. Also, the body of the supporter transporter 570 is arranged to be positioned on an opposite side of the nozzle 560 with respect to the rotation axis 532 when seen from the first direction. In other words, when seen from the first direction, the nozzle 560 may be arranged to be positioned higher than the rotation axis 532, and the body of the supporter transporter 570 may be arranged to be positioned lower than the rotation axis 532. Meanwhile, the supporter transporter 570 may be, for example, a submotor, but the idea of the present invention is not necessarily limited thereto.

The transport device 600 may transport the eyelash support member 3 when the application of the adhesive agent is completed. The transport device 600 may comprise a transport hand (not illustrated) and a conveyer. The transport hand may be configured of a picker, a hand and a gripper, etc., which may hold the eyelash support member 3, and an embodiment thereof would be obvious to a person skilled in the art, and thus the detailed explanation thereon would be omitted.

The control unit 700 may control the operation, the position and the movement of the support member dispenser 300, the support member holder 400, the adhesive agent applicator 500, and the transport device 600. Also, an input unit for operation of a user may be provided at the control unit 700. The control unit 700 may be implemented by a computing device comprising a microprocessor, and an embodiment thereof would be obvious to a person skilled in the art, and thus the detailed explanation thereon would be omitted.

Hereinafter, the operation process of the adhesive agent application device 1 having the above constitution and the method for applying the adhesive agent will be explained.

First, a plurality of eyelash support members 3 in a state before the adhesive agent is applied are introduced into the support member storing unit 200 (eyelash support member preparing step S100). The eyelash support member 3 is stacked in the third direction and stored in the support member storing unit 200. For example, as shown in FIG. 4, the adhesive portion 3*a* of the eyelash support member 3 may be placed to be extended along a horizontal surface on the support member storing unit 200. In the eyelash support member preparing step S100, the eyelash support member 3 may be introduced into the support member storing unit 200 in a state where the support member storing unit 200 is separated from the main frame 100, and the support member storing unit 200 may be combined with the main frame 100 when the introduction is completed.

When the introduction of the eyelash support member 3 and the combination of the support member storing unit 200 are completed, the control unit 700 operates the support member dispenser 300 (dispensing step S200). In the dispensing step S200, the eyelash support member 3 may move in a horizontal direction so as not to rotate. The dispenser operating unit 320 of the support member dispenser 300 may move the eyelash support member 3 positioned at a lowest end of the support member storing unit 200 along the first direction, and accordingly, the eyelash support member 3 positioned at the lowest end among the plurality of eyelash support members 3 stored in the support member storing unit 200 may be mounted on a mounting groove 431 of the operation arm 430 of the support member holder 400.

When the eyelash support member 3 is mounted on the mounting groove 431, the operation arm 430 moves to the fixed arm 420 by the arm operating unit 440, and when the movement of the fixed arm 420 is completed, the eyelash support member 3 retains the posture and the position thereof between the fixed arm 420 and the operation arm 430 (holding step S300). The holding step S300 may comprise an operation arm moving step S310 and an engaging step S320.

In the operation arm moving step S310, when the actuator 441 is driven, the rotation link 442 rotates with respect to the link unit 433 of the operation arm 430, and the link unit 433 and the mounting groove 431 connected thereto rotate with respect to the axis unit 432 by the rotation link 442. Accordingly, the operation arm 430 rotates so that the adhesive portion 3*a* of the eyelash support member 3 faces upwards, and during the rotation, the mounting groove 431 advances to the holding groove 421. Then, in the engaging step S320, when the movement of the operation arm is completed, the eyelash support member 3 is engaged between the fixed arm 420 and the operation arm 430. The driving of the actuator 441 is controlled by the control unit 700.

Thereafter, an adhesive agent is applied to the adhesive portion 3*a* of the eyelash support member 3 by the adhesive agent applicator 500 (adhesive agent applying step S400). The adhesive agent applying step S400 may comprise a first nozzle rotating step S410, a nozzle advancement moving step S420, a second nozzle rotating step S430, and a nozzle retreating step S440.

In the first nozzle rotating step S410, before the nozzle 560 sprays the adhesive agent, the rotation arm driver 530 may rotate the rotation arm 520 so that the nozzle 560 is tilted at a predetermined angle with respect to the third direction. By the rotation of the rotation arm 520, the spraying hole of the nozzle 560 is positioned at an end part at one side of the adhesive portion 3*a* of the eyelash support member 3.

Figure 8:
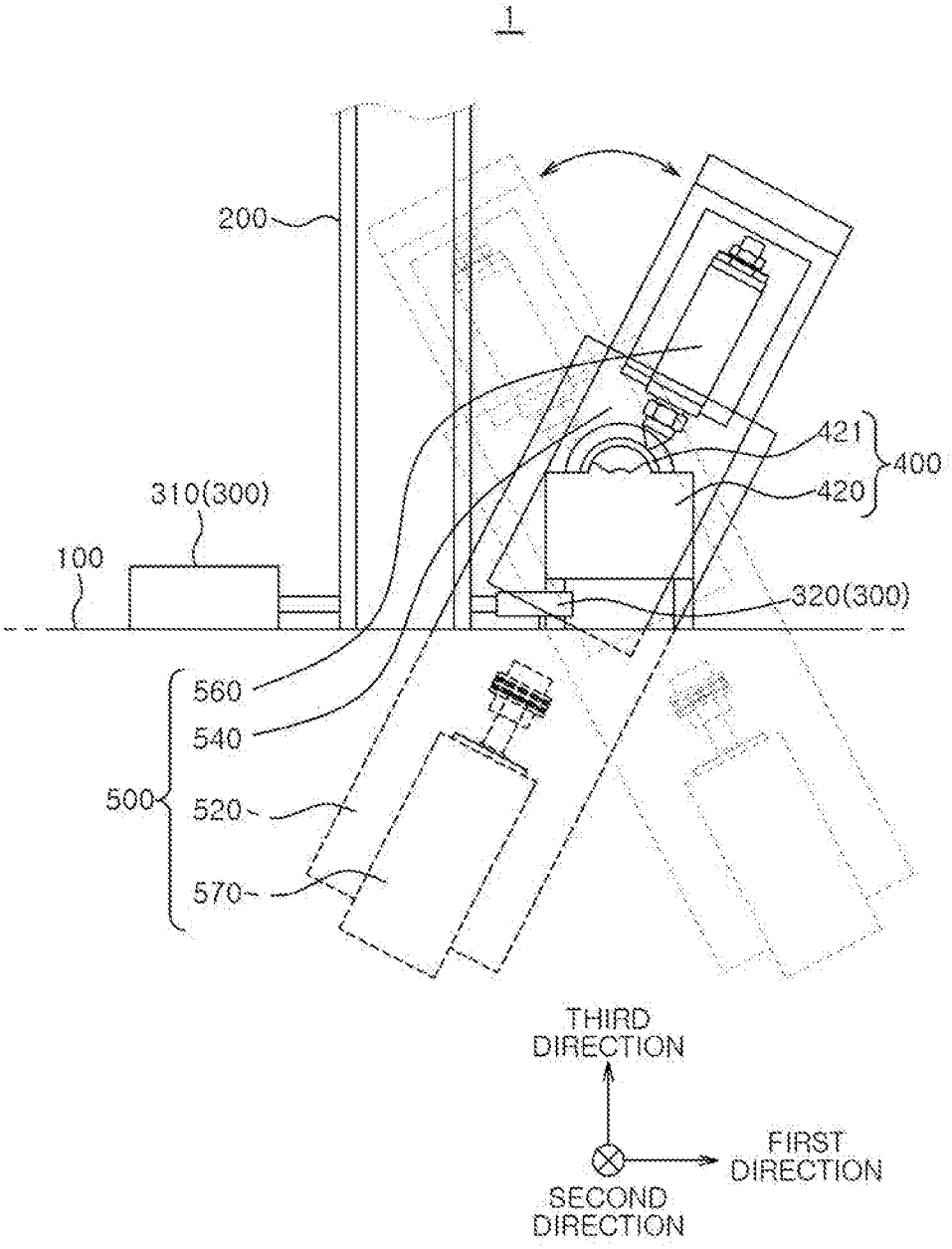
FIG. 8 is a front view illustrating a process of applying an adhesive agent to the eyelash support member by the adhesive agent applicator of FIG. 7.
Figure 9:
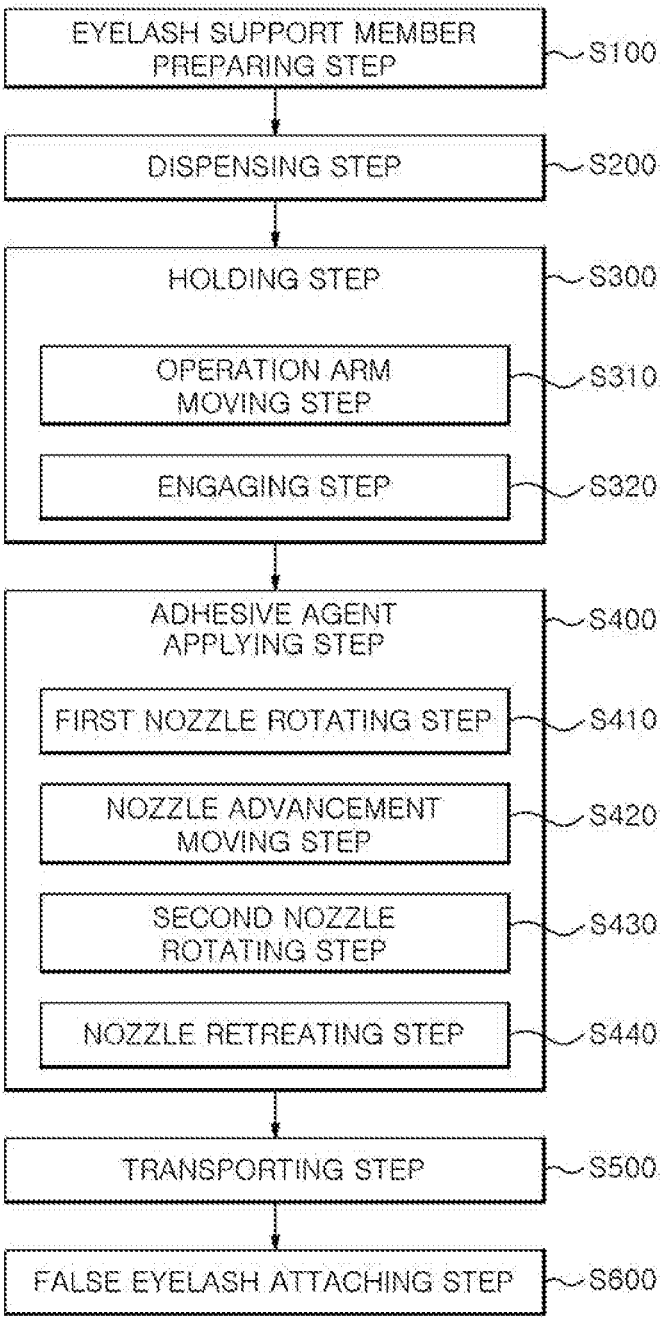
FIG. 9 is a flow chart illustrating a process of applying an adhesive agent to the eyelash support member according to the adhesive agent application device of FIG. 1 and a process of producing the eyelash supporter using the same.

Thereafter, in the nozzle advancement moving step S420, the supporter transporter 570 moves the nozzle supporter 540 towards the adhesive portion 3*a* of the eyelash support member 3. In the nozzle advancement moving step S420, the spraying hole of the nozzle 560 may move to advance to the adhesive portion 3*a* as much as possible. The supporter transporter 570 may move the nozzle 560 so that the spraying hole of the nozzle 560 advances to an end part at one side of the adhesive portion 3*a*. In other words, as illustrated in FIG. 8, the nozzle 560 may move toward the adhesive portion 3*a* in a state tilted at a predetermined angle with respect to the third direction.

Thereafter, in the second nozzle rotating step S430, the rotation arm driver 530 rotates the rotation arm 520. At the same time, the nozzle 560 sprays the adhesive agent to the adhesive portion 3*a*. By this rotation, the nozzle 560 rotates in the direction of a circular arc with respect to the center of the eyelash support member 3. This rotation allows the nozzle 560 to spray the adhesive agent along the adhesive portion 3*a* of a circular arc shape. The nozzle 560 starts from a position tilted at a predetermined angle with respect to the third direction by a rotation axis 532, and reaches a position at an opposite side which is symmetrical with respect to the axis of the third direction. Therefore, the adhesive agent is sprayed symmetrically with respect to the axis of the third direction.

In the nozzle retreating step S440, after the spraying of an adhesive agent is completed, the supporter transporter 570 transports the nozzle supporter 540 so that the spraying hole of the nozzle 560 recedes from the adhesive portion 3*a* of the eyelash support member 3. As the nozzle 560 recedes from the eyelash support member 3, the transport device 600 prepares a space for taking the eyelash support member 3 out of the adhesive agent applicator 500.

When the adhesive agent applying step S400 is completed, the eyelash support member 3 to which an adhesive agent is attached is taken out from the adhesive agent applicator 500 by the transport device 600 (transporting step S500). In the transporting step S500, the transport device 600 holds the eyelash support member 3 in the adhesive agent applicator 500 by a gripper and conveys the same to a conveyer belt, and then the conveyer belt may convey the eyelash support member 3.

The eyelash support member 3 to which an adhesive agent is applied is taken out from the adhesive agent applicator 500 by the transport device 600, and then the eyelash attaching device (not illustrated) attaches false eyelashes to the adhesive agent applied to the eyelash support member 3 (false eyelash attaching step S600). The adhesive agent of a circular arc shape applied to the eyelash support member 3 is adhered to a strand having a circular arc shape. As a result, the false eyelashes are mounted on the eyelash support member 3 by the adhesive agent. The adhesive agent is coupled to the strand of false eyelashes through a physical and chemical reaction, and has a stronger binding force than the binding force between the eyelash support member 3 and the adhesive agent. Therefore, when a user tears off the false eyelashes from the eyelash support member 3, the adhesive agent would fall off together with the false eyelashes. The user may attach the adhesive agent close to his/her own eyelashes and easily use the false eyelashes.

Meanwhile, an eyelash supporter 3' may be produced by using the method for applying adhesive agent according to an embodiment. The method for producing an eyelash supporter 3' includes the same technical idea as the method for applying an adhesive agent explained in the above, and thus overlapping explanation is omitted and the method is the same as explained in the above relating to the method for applying an adhesive agent.

The present invention has been described with reference to detailed embodiments, but the embodiments are only illustrative. The present invention shall not be limited thereto, and it should be interpreted that the present invention covers the broadest scope within the basic idea disclosed in the present specification. A person skilled in the art may carry out patterns in a shape not disclosed in the present invention by combining/substituting embodiments disclosed herein, but such combinations or substitutions do not deviate from the scope of the present invention. Also, a person skilled in the art may make simple modifications or alternations to the embodiments based on the present specification, and it is obvious that such modifications or alternations belong to the scope of right of the present invention.

What is claimed is:

1. An adhesive agent application device, comprising:

a main frame;

a support member holder fixedly holding an eyelash support member;

an adhesive agent applicator configured to apply an adhesive agent to an adhesive portion of the eyelash support member held on the support member holder;

wherein the adhesive agent applicator comprises:

a nozzle configured to apply the adhesive agent; and a rotation arm connected to the nozzle, the rotation arm being rotatable with respect to the support member holder;

wherein the support member holder comprises:

a fixed arm fixed to the main frame to support a part of the eyelash support member; and an operation arm configured to be movable in a direction getting closer to the fixed arm so as to support the other part of the eyelash support member.

2. The adhesive agent application device of claim 1, wherein the support member holder fixedly holds the eyelash support member so as to retain a position and a posture of the eyelash support member while the adhesive agent is applied to the adhesive portion of the eyelash support member.

3. The adhesive agent application device of claim 2, wherein the rotation arm rotates the nozzle so that the nozzle moves along a moving path of an upwardly convex circular arc shape, and wherein the nozzle is configured to apply, by the rotation arm, the adhesive agent in a circular arc shape at a position between the moving path of an upwardly convex circular arc shape of the nozzle and the rotation center of the nozzle.

4. The adhesive agent application device of claim 1, wherein the adhesive agent applicator further comprises:

a nozzle supporter supporting the nozzle, the nozzle supporter being connected to the rotation arm to be movable with respect to the rotation arm; and a supporter transporter for moving the nozzle supporter with respect to the rotation arm.

5. The adhesive agent application device of claim 4, wherein the nozzle supporter is configured to perform a linear movement in a direction toward or away from the eyelash support member held on the support member holder.

6. The adhesive agent application device of claim 5, wherein the adhesive agent applicator further comprises a rotation arm driver for rotating the rotation arm, and the nozzle is rotated with respect to the eyelash support member held on the support member holder by the rotation arm rotated by the rotation arm driver.

7. The adhesive agent application device of claim 6, wherein the rotation arm driver is driven to position the nozzle at an end part at one side of the adhesive portion of the eyelash support member before the adhesive agent is applied from the nozzle, and wherein the nozzle supporter is driven to perform the linear movement in the direction toward the eyelash support member when the nozzle is positioned at an end of the adhesive portion of the eyelash support member.

8. An adhesive agent application device comprising:

a support member holder fixedly holding an eyelash support member;

an adhesive agent applicator configured to apply an adhesive agent to an adhesive portion of the eyelash support member held on the support member holder;

wherein the adhesive agent applicator comprises:

a nozzle configured to apply the adhesive agent; and a rotation arm connected to the nozzle, the rotation arm being rotatable with respect to the support member holder;

a support member storing unit for storing eyelash support members; and a support member dispenser for dispensing an eyelash support member stored in the support member storing unit from the support member storing unit;

wherein the support member holder is configured to receive the eyelash support member dispensed by the support member dispenser and moving the eyelash support member received to the nozzle side.

9. The adhesive agent application device of claim 8, wherein the eyelash support member includes a plurality of eyelash support members;

wherein the support member storing unit is configured such that the plurality of eyelash support members are vertically stacked and stored in the support member storing unit; and wherein the adhesive portion of the plurality of eyelash support members stored in the support member storing unit is arranged to face the horizontal direction.

10. The adhesive agent application device of claim 1, wherein a mounting groove having the other surface of the eyelash support member mounted thereon is formed on the operation arm; and wherein the support member dispenser is configured to allow the eyelash support member arranged at the lowest position in the support member storing unit to be mounted on the mounting groove of the operation arm through linear movement.

* * * * *